US011814825B2

(12) United States Patent
Lee et al.

(10) Patent No.: US 11,814,825 B2
(45) Date of Patent: Nov. 14, 2023

(54) TELESCOPIC STRUCTURE OF FAUCET HAVING MOVABLE TUBE

(71) Applicant: Ching Shenger Co., Ltd., Xianxi Township (TW)

(72) Inventors: Chin-Tsai Lee, Xianxi Township (TW); Ming-Che Lee, Xianxi Township (TW)

(73) Assignee: Ching Shenger Co., Ltd., Xianxi Township (TW)

( * ) Notice: Subject to any disclaimer, the term of this patent is extended or adjusted under 35 U.S.C. 154(b) by 261 days.

(21) Appl. No.: 17/308,191

(22) Filed: May 5, 2021

(65) Prior Publication Data

US 2022/0356684 A1 Nov. 10, 2022

(51) Int. Cl.
*E03C 1/04* (2006.01)

(52) U.S. Cl.
CPC .... *E03C 1/0404* (2013.01); *E03C 2001/0415* (2013.01)

(58) Field of Classification Search
CPC ..... E03C 2001/0415; E03C 2001/0417; E03C 2001/026; E03C 1/0407; E03C 1/0404; F16K 47/08; F16K 3/32; F16K 11/0782; F16K 19/006
See application file for complete search history.

(56) References Cited

U.S. PATENT DOCUMENTS 5,303,737 A * 4/1994 Koch ..... F16K 11/0787 251/127
2005/0189438 A1* 9/2005 Bosio ..... E03C 1/0405 239/443
2016/0215482 A1* 7/2016 Fourman ..... E03C 1/0404
2020/0123741 A1* 4/2020 Huang ..... E03C 1/0404

FOREIGN PATENT DOCUMENTS

EP 1201836 A2 * 5/2002 ..... E03C 1/0404

* cited by examiner

*Primary Examiner* — Janie M Loeppke

(57) ABSTRACT

A telescopic structure of a faucet having a movable tube contains: a body, a water supply tube, a movable tube, a spring, and a depressurization element. The body includes a screwing portion, a coupling portion, and a water outlet. The water supply includes an upright extension and an opening. The movable tube includes a slide portion and a water head engaged with the opening of the water supply tube and is pulled with the movable tube based on using requirements. The spring is accommodated in the upright extension and is fitted on the movable tube. The depressurization element includes a first face, a second face opposite to the first face, a peripheral face defined between and connected with the first face and the second face, and multiple flowing apertures defined proximate to a center of the depressurization element and communicating with the first face and the second face.

12 Claims, 10 Drawing Sheets

TELESCOPIC STRUCTURE OF FAUCET HAVING MOVABLE TUBE

BACKGROUND OF THE INVENTION

Field of the Invention

The present invention relates to a faucet structure, and more particularly to a telescopic structure of a faucet having a movable tube.

Description of the Prior Art

A conventional faucet is mounted on a countertop vertically so as to be operated easily, wherein a control valve is fixed on a side of a body of a faucet, and a water supply tube is disposed on a top of the body. However, a range of a water supply of the faucet cannot satisfy using requirement when washing the countertop. To overcome such a problem, a faucet having an inner tube has been developed, wherein the faucet also has a water supply tube which accommodates a movable tube, such that the movable tube is connected with a threaded pipe of the control valve after an end of the movable tube is inserted through the body, and the other end of the movable tube is connected with a water head engaged on an outer wall of the water supply tube, such that the movable tube is pulled outward to wash the countertop fully or other space at a large extending range. In other words, the movable tube is pulled outward by pulling water head to extend to a desired position freely.

But the movable tube is inserted through the body in a limited space of the body because the body receives the control valve, an inlet tube and an outlet tube. Furthermore, a counterweight is fixed on the movable tube, thus increasing a size of the body. The movable tube is flexible and it will be interfered by the control valve when being inserted through the body from an opening of the water supply tube, thus causing troublesome connection. Also, water flows out of the water head of the movable tube via a water outlet of the body and the movable tube to produce a large pressure of the water in the movable tube, hence the movable tube is pushed by the large pressure of the water to drop. In addition, after pulling the movable tube and releasing the water head, the movable tube cannot retract back to an original position automatically and the large pressure produces in the movable tube, thus causing vibration and making noises.

The present invention has arisen to mitigate and/or obviate the afore-described disadvantages.

SUMMARY OF THE INVENTION

The primary object of the present invention is to provide a telescopic structure of a faucet having a movable tube which contains a depressurization sheet configured to reduce a pressure of water of a movable tube to avoid a dropping of the movable tube when a water head of the movable tube supplies the water and the movable tube is pressed by the pressure of the water, to prevent a failure of a retraction of the movable tube after releasing the water head, and to eliminate vibration and noises of the movable tube.

Further object of the present invention is to provide a telescopic structure of a faucet having a movable tube which contains the movable tube and a spring received in the water supply tube so as to maintain a structure of a body and to reduce a size of the body, thus obtaining easy fabrication.

Another object of the present invention is to provide a telescopic structure of a faucet having a movable tube by which the movable tube does not inserted through the body to obtain easy installation and maintenance and to reduce a defective rate of a connection of the telescopic structure.

To obtain above-mentioned aspect, a telescopic structure of a faucet having a movable tube provided by the present invention contains: a body, a water supply tube, a movable tube, a spring, and a depressurization element.

The body includes a screwing portion formed on an outer wall of a top of the body, a coupling portion, and a water outlet, wherein the water outlet has an accommodation portion defined thereon.

The water supply tube is hollow, the water supply tube includes an upright extension formed on a first end of the water supply tube, and the water supply tube includes an opening formed on a second end of the water supply tube. The upright extension has a fixing portion extending on a bottom thereof and fitted with a screw element, and the fixing portion is screwed with the screwing portion of the body by way of the screw element.

The movable tube is slidably inserted in the water supply tube, and the movable tube includes a slide portion formed on a first end of the movable tube, and a water head formed on a second end of the movable tube and connected with the water supply tube. The water head is engaged with the opening of the water supply tube and is pulled with the movable tube based on using requirements.

The spring is accommodated in the upright extension of the water supply tube and is fitted on the movable tube. A first end of the spring is positioned adjacent to a top of the upright extension of the water supply tube, and a second end of the spring contacts with the slide portion of the movable tube. When the water head is pulled outward, the spring is pressed by the slide portion of the movable tube until a maximum pressing force of the slide portion exerts to the spring, then the water head is released so that the spring bounces to drive the movable tube to retract until the slide portion is engaged with the body, and the movable tube and the water head move back to the original position.

The depressurization element includes a first face, a second face opposite to the first face, a peripheral face defined between and connected with the first face and the second face, and multiple flowing apertures defined proximate to a center of the depressurization element and communicating with the first face and the second face. The depressurization element is received in the accommodation portion of the body, and the depressurization element is configured to reduce a pressure of the water from the body to the movable tube.

DETAILED DESCRIPTION OF THE PREFERRED EMBODIMENTS

Figure 1:
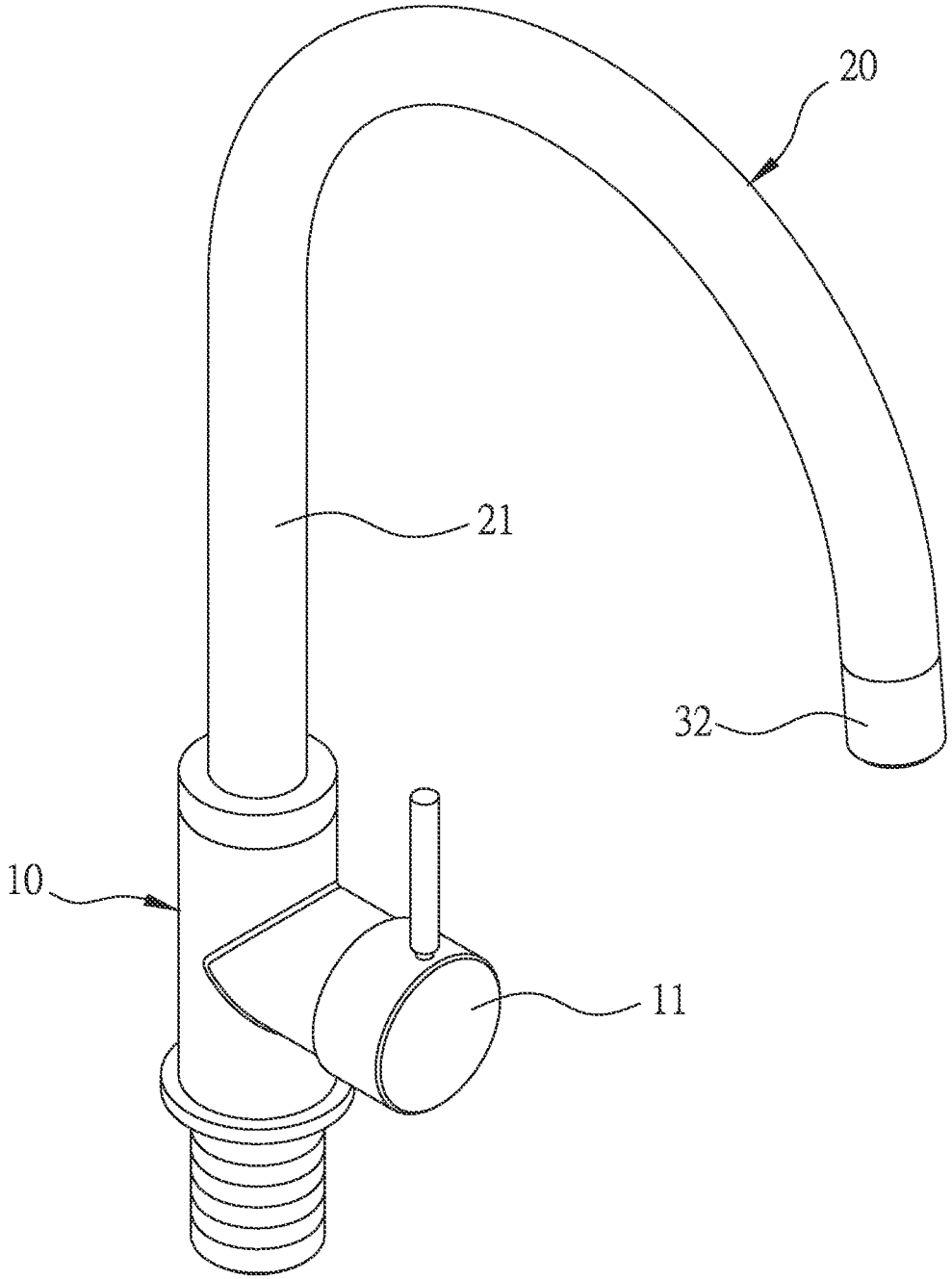
FIG. 1 is a perspective view showing the assembly of a telescopic structure of a faucet according to a preferred embodiment of the present invention.
Figure 2:
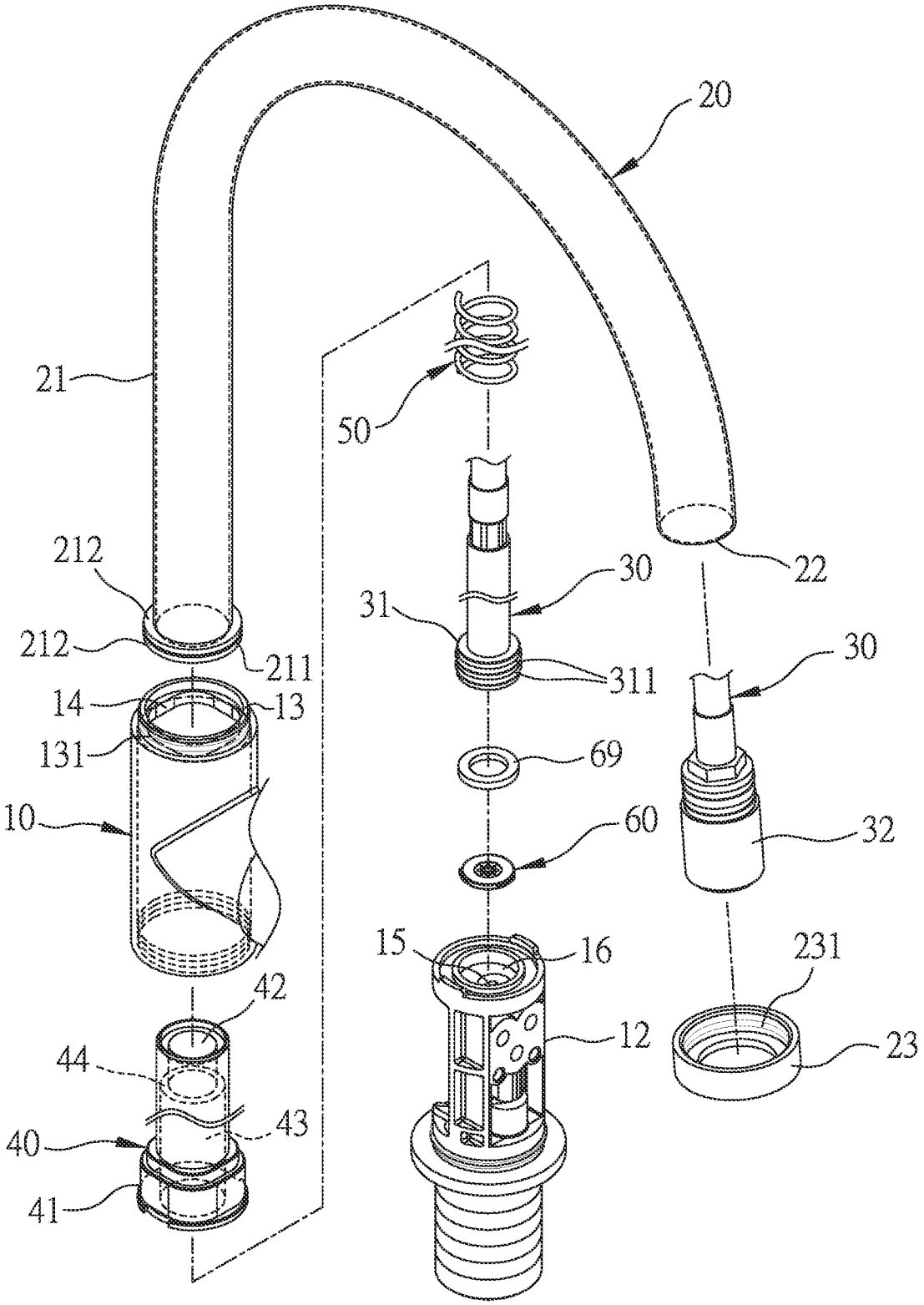
FIG. 2 is a perspective view showing the exploded components of the telescopic structure of the faucet according to the preferred embodiment of the present invention.
Figure 3:
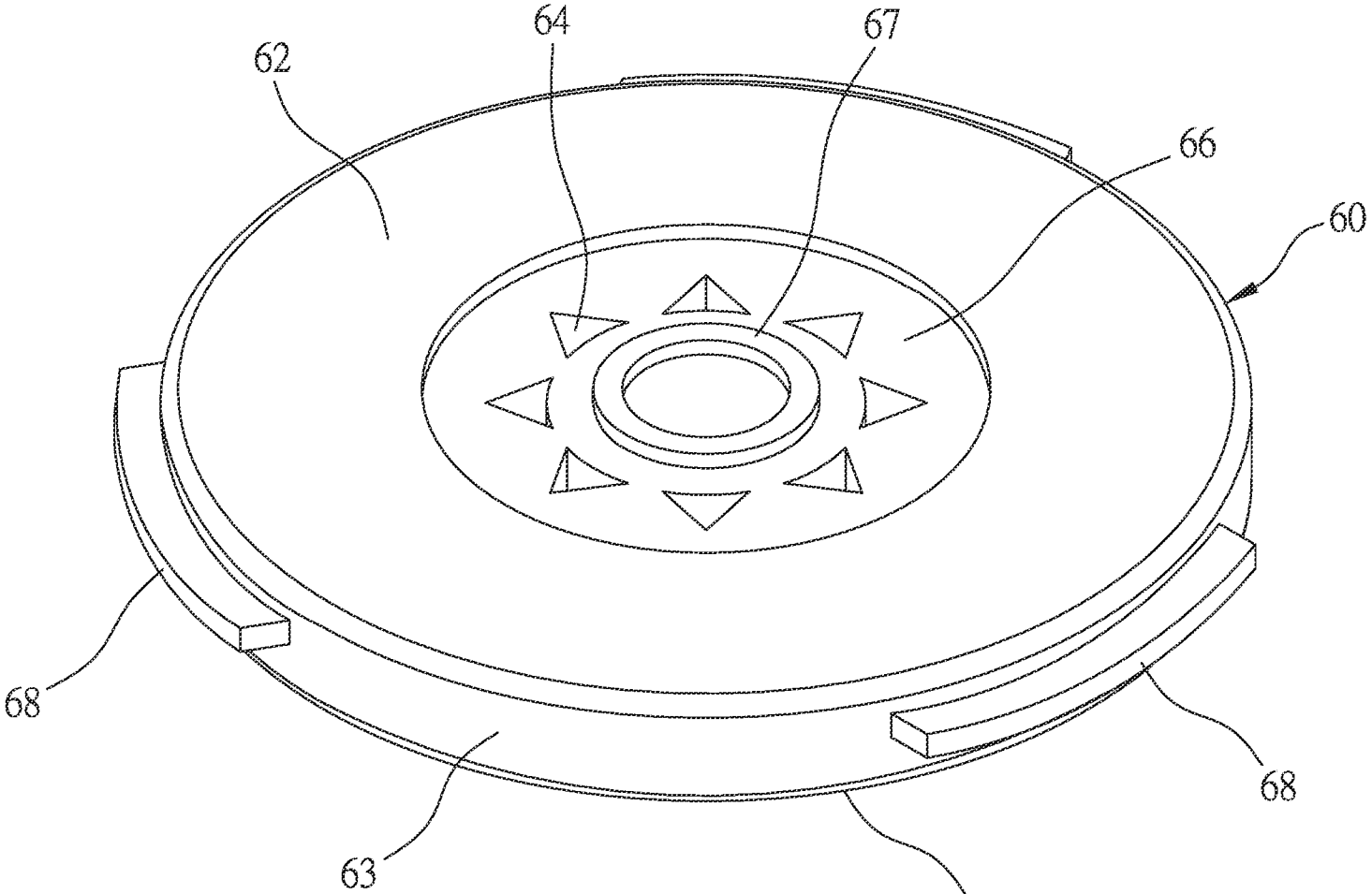
FIG. 3 is a perspective view showing the assembly of a depressurization element of the telescopic structure of the faucet according to the preferred embodiment of the present invention.
Figure 4:
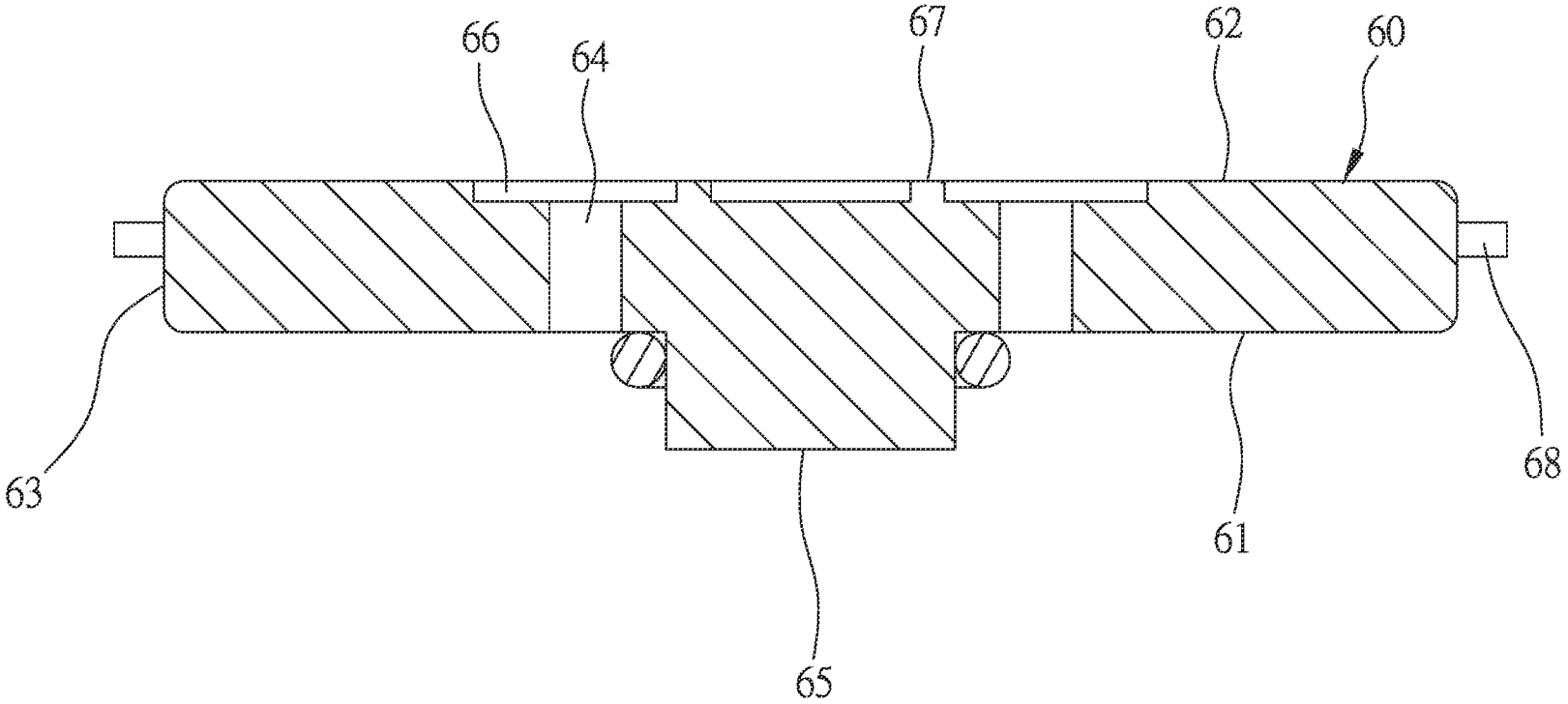
FIG. 4 is a cross sectional view showing the assembly of the depressurization element of the telescopic structure of the faucet according to the preferred embodiment of the present invention.
Figure 5:
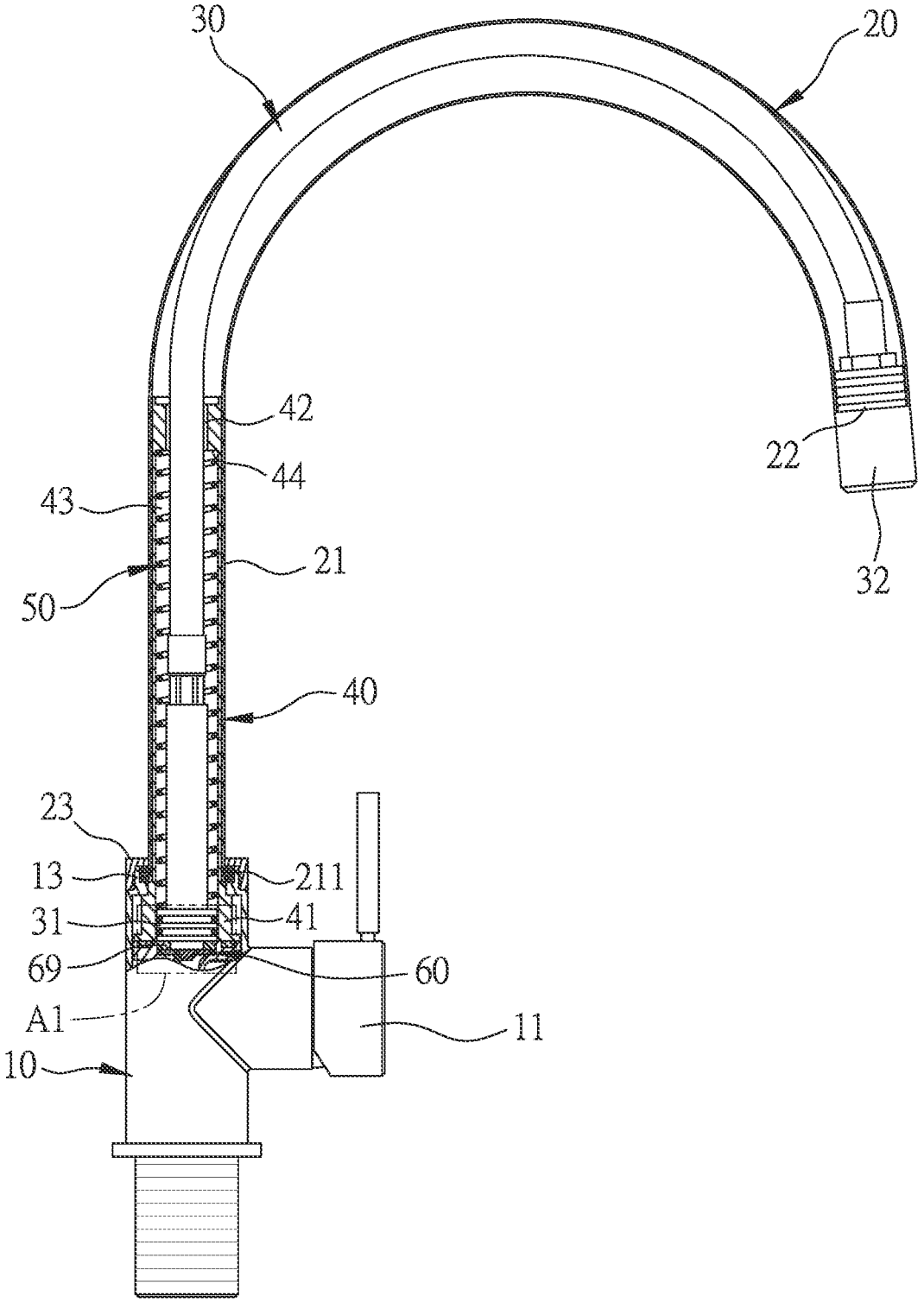
FIG. 5 is a cross sectional view showing the assembly of the telescopic structure of the faucet according to the preferred embodiment of the present invention.
Figure 6:
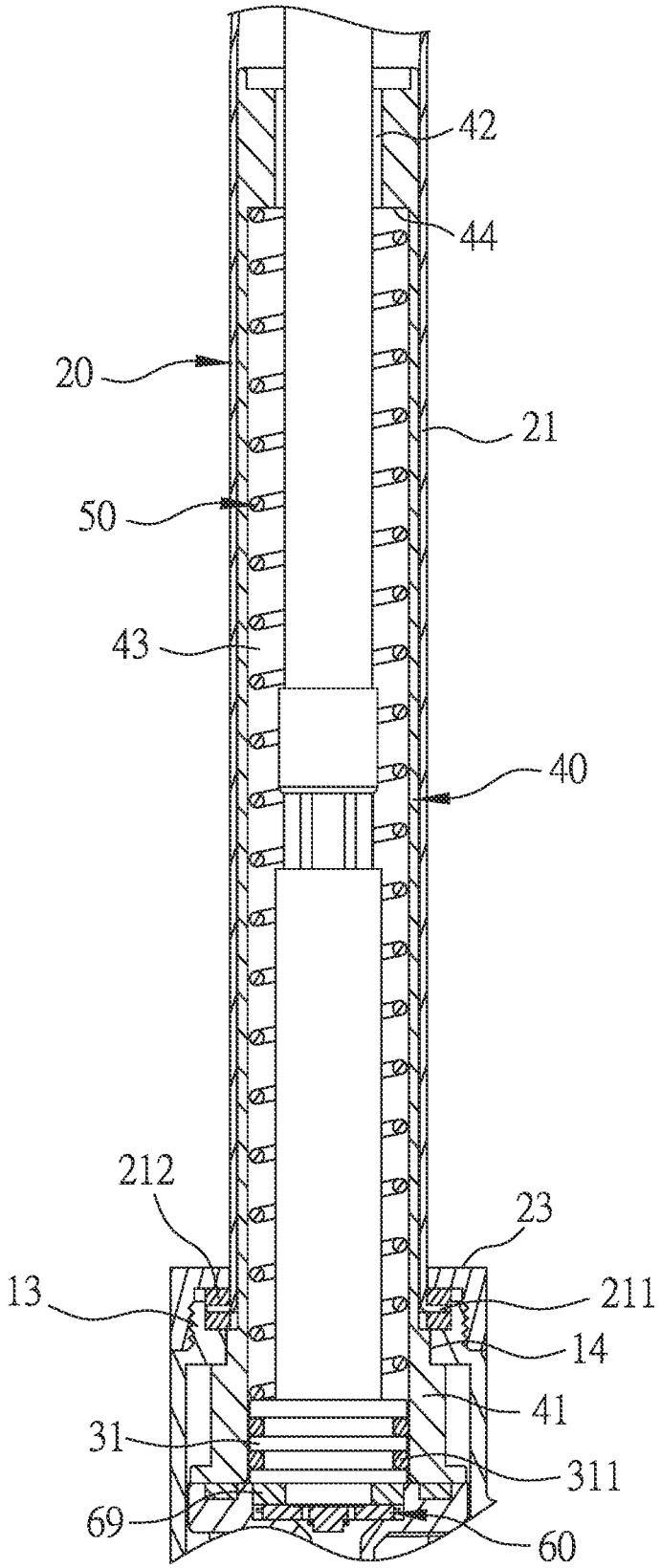
FIG. 6 is an amplified cross sectional view of a part of FIG. 5.
Figure 7:
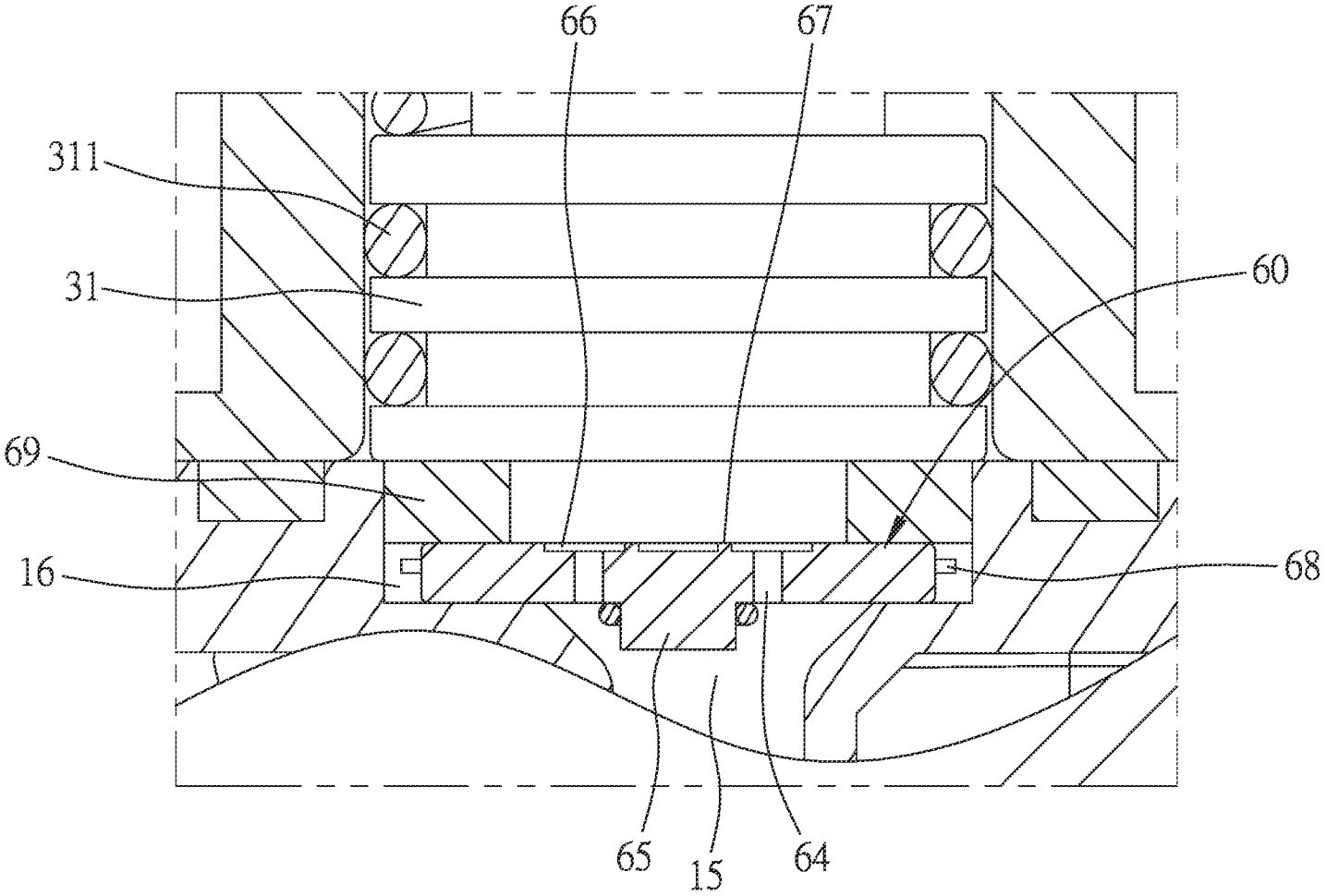
FIG. 7 is an amplified cross sectional view of a portion A1 of FIG. 5.

The present invention will be clearer from the following description when viewed together with the accompanying drawings, which show, for purpose of illustrations only, a preferred embodiment in accordance with the present invention.

With reference to FIGS. 1-7, a telescopic structure of a faucet having a movable tube according to a preferred embodiment of the present invention comprises a body 10 of the faucet, a water supply tube 20, the movable tube 30, a fitting pipe 40, a spring 50, and a depressurization element 60.

The body 10 includes a water control portion 11 mounted on an outer wall thereof, a guide seat 12 received in the body 10, a screwing portion 13 formed on an outer wall of a top of the body 10, a coupling portion 14, and a water outlet 15, wherein the screwing portion 13 is formed on a top of an upper end of the body 10, the screwing portion 13 has an external thread 131, the coupling portion 14 is formed on an inner wall of the upper end of the body 10, and the water outlet 15 is defined on a top of the guide seat 12 and has an accommodation portion 16 defined thereon.

The water supply tube 20 is hollow and is made of metal, the water supply tube 20 includes an upright extension 21 formed on a first end thereof, and the water supply tube 20 includes an opening 22 formed on a second end thereof, wherein the upright extension 21 has a fixing portion 211 extending on a bottom thereof and fitted with a screw element 23, wherein the fixing portion 211 protrudes annularly and has two washers 212 fitted on a top and a bottom thereof. The screw element 23 has an internal thread 231 formed thereon, and the fixing portion 211 is screwed with the external thread 131 of the screwing portion 13 of the body 10 by way of the internal thread 231 of the screw element 23 so that the water supply tube 20 is connected with the body 10, and the two washers 212 of the fixing portion 211 are configured to stop water.

The movable tube 30 is slidably inserted in the water supply tube 20, and the movable tube 30 includes a slide portion 31 formed on a first end thereof, wherein the slide portion 31 has at least one seal ring 311 fitted thereon (in this embodiment, there are two seal rings 311 fitted on the slide portion 31), and the movable tube 30 further includes a water head 32 formed on a second end thereof and connected with the water supply tube 20, wherein the water head 32 is engaged with the opening 22 of the water supply tube 20 and is pulled with the movable tube 30 based on using requirements.

The fitting pipe 40 includes a joining portion 41 formed on a bottom thereof and is fitted in the upright extension 21 of the water supply tube 20, and the joining portion 41 is fitted with the coupling portion 14 of the body 10. The fitting pipe 40 further includes a through hole 42 defined adjacent to a top of the fitting pipe 40, a receiving orifice 43 passing through the joining portion 41 and communicating with the through hole 42, and a shoulder 44 formed on a connection portion of the receiving orifice 43 and the through hole 42, wherein the through hole 42 and the receiving orifice 43 are configured to accommodate the movable tube 30, and the slide portion 31 of the movable tube 30 is slidably received in the receiving orifice 43 of the fitting pipe 40.

The spring 50 is accommodated in the receiving orifice 43 of the fitting pipe 40 and is fitted on the movable tube 30, such that the fitting pipe 40 separates the spring 50 from the water supply tube 20 to avoid a friction of the spring 50 with the water supply tube 20, thus eliminating contact noises. A first end of the spring 50 abuts against the shoulder 44 of the fitting pipe 40 and is positioned adjacent to a top of the upright extension 21 of the water supply tube 20, and a second end of the spring 50 contacts with the slide portion 31 of the movable tube 30. When the water head 32 is pulled outward with the movable tube 30, the spring 50 is pressed by the slide portion 31 of the movable tube 30 until a maximum pressing force of the slide portion 31 exerts to the spring 50. Then, the water head 32 is released so that the spring 50 bounces to drive the movable tube 30 to retract until the slide portion 31 is engaged with the body 10, and the movable tube 30 and the water head 32 move back to the original position.

The depressurization element 60 is annular and includes a first face 61, a second face 62 opposite to the first face 61, a peripheral face 63 defined between and connected with the first face 61 and the second face 62, multiple flowing apertures 64 defined proximate to a center of the depressurization element 60 and communicating with the first face 61 and the second face 62, wherein the multiple flowing apertures 64 are separately and annularly defined proximate to the center of the depressurization element 60, a cross section of a respective flowing aperture 64 is triangular, the first face 61 has a column 65 extending from a center thereof, and the second face 62 has a circular notch 66 defined on a center thereof, wherein the multiple flowing apertures 64 are located in the circular notch 66, and the notch 66 has a circular rib 67 extending on a center thereof inside the multiple flowing apertures 64, and the peripheral face 63 has multiple wings 68 arranged separately. The depressurization element 60 is received in the accommodation portion 16 of the body 10 and is fixed by an annular defining sheet 69, and the depressurization element 60 is configured to reduce a pressure of the water from the body 10 to the movable tube 30.

Figure 8:
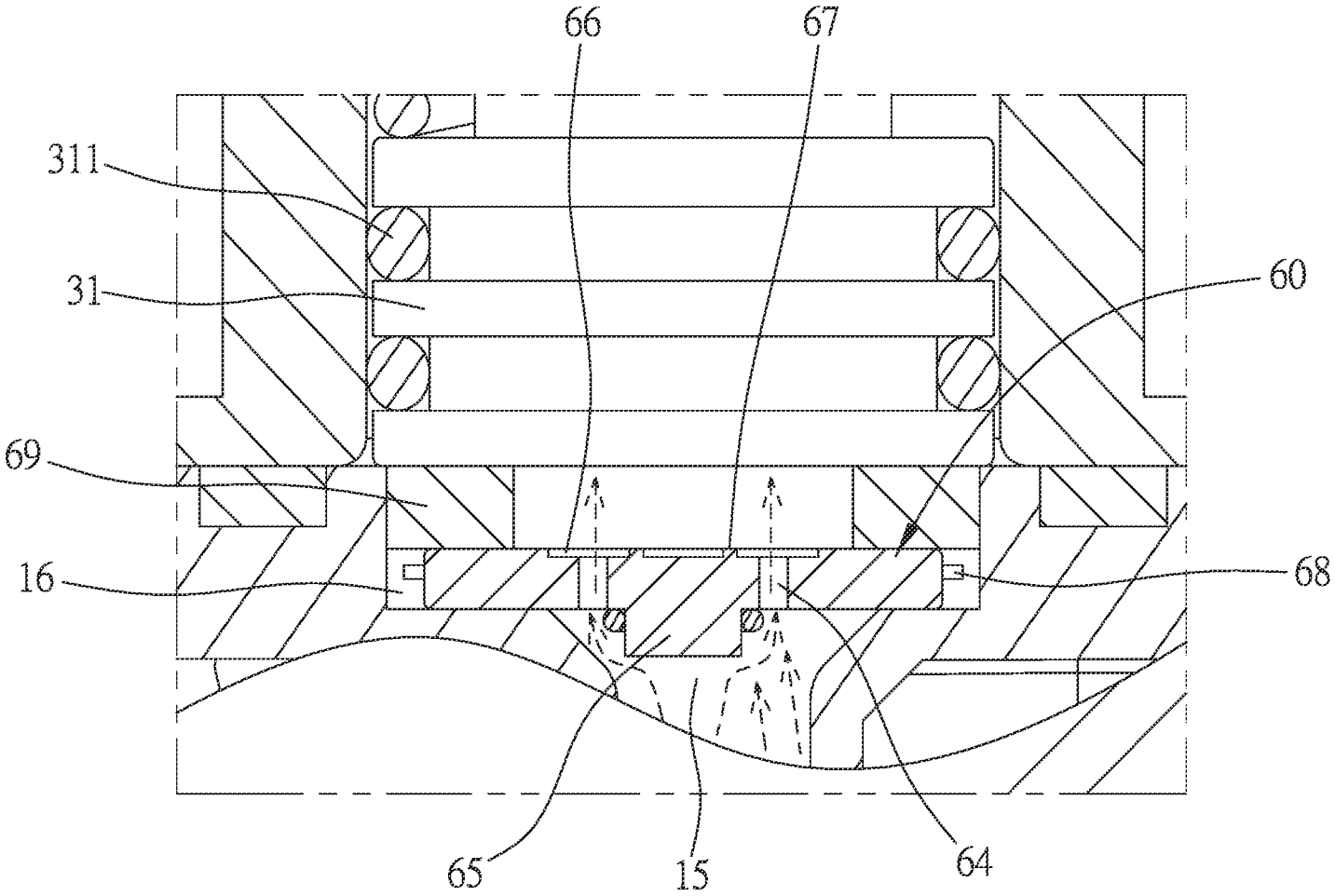
FIG. 8 is an amplified cross sectional view of the portion A1 of FIG. 5 showing the operation of the telescopic structure of the faucet according to the preferred embodiment of the present invention.
Figure 9:
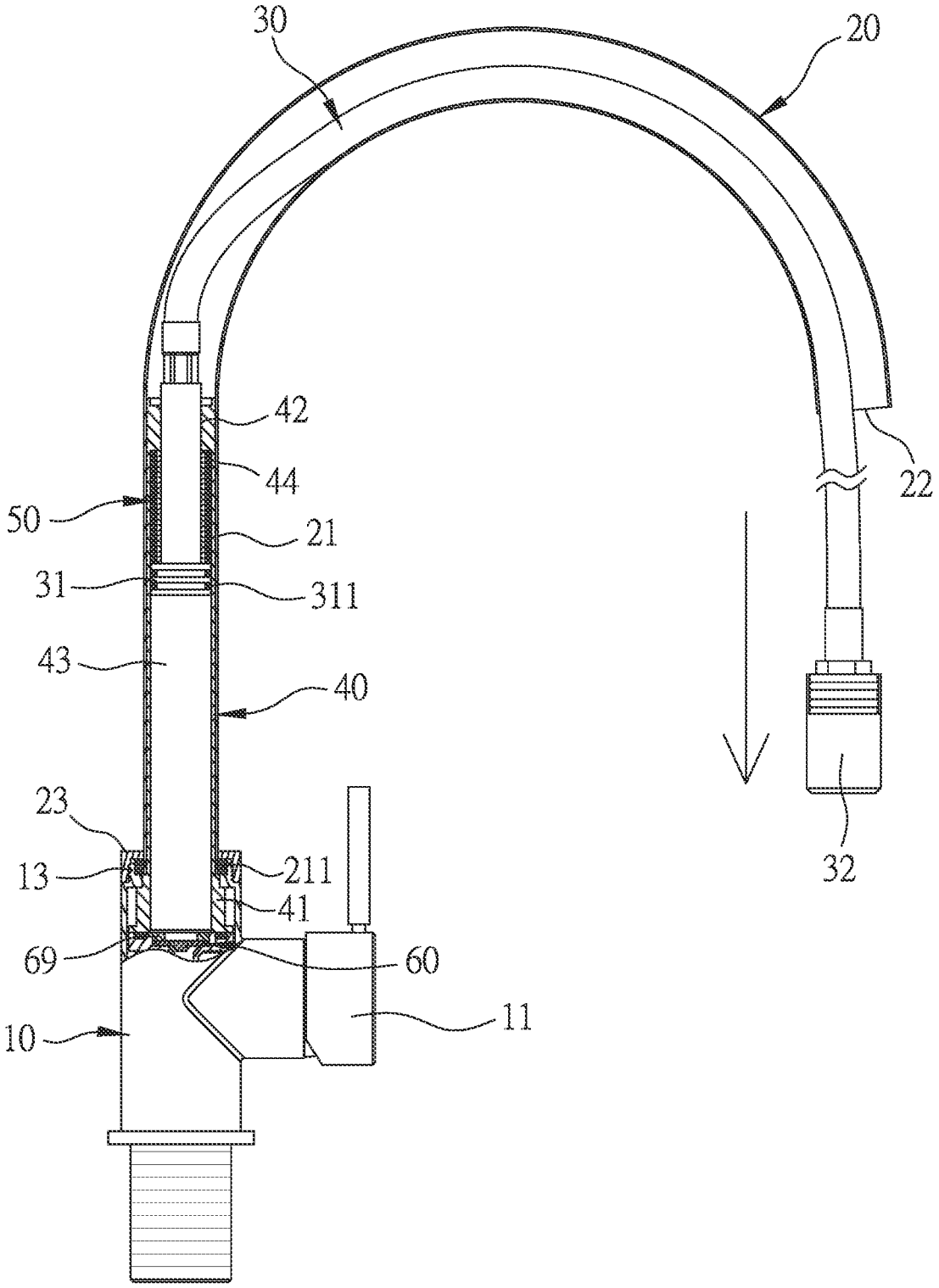
FIG. 9 is a cross sectional view showing the operation of the telescopic structure of the faucet according to the preferred embodiment of the present invention.
Figure 10:
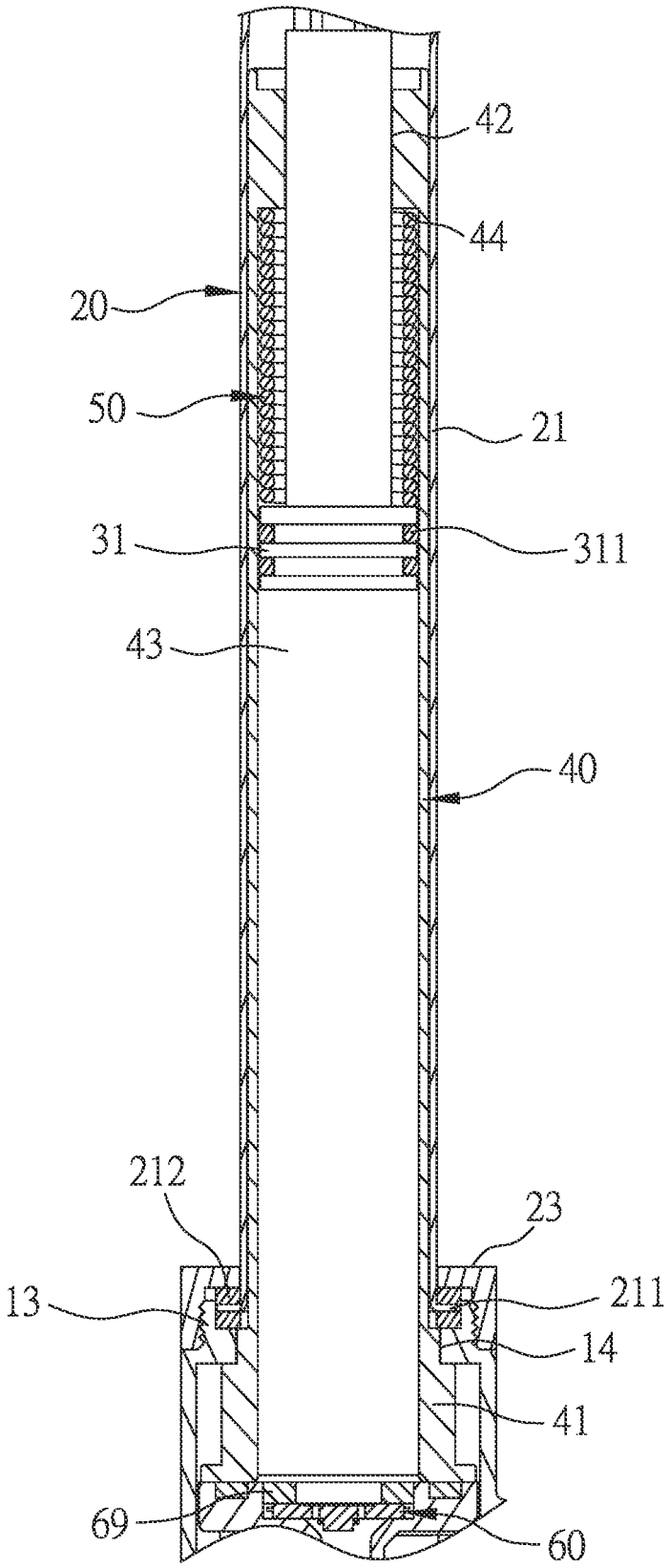
FIG. 10 is an amplified cross sectional view of a part of FIG. 9.

In use, the water control portion 11 is configured to control a mixing ratio of cold water and hot water, supply, and stop the water. As shown in FIG. 8, the water flows through the water outlet 15 of the body 10 and the multiple flowing aperture 64 of the depressurization sheet 60 so as to reduce the pressure of the water. Then, the water flows out of the water head 32 of the movable tube 30 after flowing into the movable tube 30. When washing a countertop or a large-size area, as illustrated in FIGS. 9 and 10, the water head 32 is pulled outward with the movable tube 30 so as to supply the water toward a desired position, in the meantime, the spring 50 is pressed by the slide portion 31 of the movable tube 30 until the maximum pressing force of the slide portion 31 exerts to the spring 50. Thereafter, the water head 32 is released so that the spring 50 bounces to drive the movable tube 30 to retract back to the water supply tube 20 until the slide portion 31 is engaged with the body 10, and the movable tube 30 and the water head 32 move back to the original position.

Thereby, the telescopic structure of the present invention has advantages as follows:

1. The depressurization sheet 60 is configured to reduce the pressure of the water of the movable tube 30 to avoid a dropping of the movable tube 30 when the water head 32 of the movable tube 30 supplies the water and the movable tube 30 is pressed by the pressure of the water, to prevent a failure of a retraction of the movable tube 30 after releasing the water head 32, and to eliminate vibration and noises of the movable tube 30.
2. The movable tube 30 and the spring 50 are received in the water supply tube 20 so as to maintain a structure of the body 10 and to reduce a size of the body 10, thus obtaining easy fabrication.
3. The movable tube 30 does not insert through the body 10 to obtain easy installation and maintenance and to reduce a defective rate of a connection of the telescopic structure.

While various embodiments in accordance with the present invention have been shown and described, it is clear to those skilled in the art that further embodiments may be made without departing from the scope of the present invention.

What is claimed is:

1. A telescopic structure of a faucet having a movable tube comprising:

a body including a screwing portion formed on an outer wall of a top of the body, a coupling portion, and a water outlet, wherein the water outlet has an accommodation portion defined thereon;

a water supply tube being hollow, the water supply tube including an upright extension formed on a first end of the water supply tube, and the water supply tube including an opening formed on a second end of the water supply tube, wherein the upright extension has a fixing portion extending on a bottom thereof and fitted with a screw element, wherein the fixing portion is screwed with the screwing portion of the body by way of the screw element;

a movable tube slidably inserted in the water supply tube, and the movable tube including a slide portion formed on a first end of the movable tube, a water head formed on a second end of the movable tube and connected with the water supply tube, wherein the water head is engaged with the opening of the water supply tube and is pulled with the movable tube based on using requirements;

a spring accommodated in the upright extension of the water supply tube and fitted on the movable tube, wherein a first end of the spring is positioned adjacent to a top of the upright extension of the water supply tube, and a second end of the spring contacts with the slide portion of the movable tube, when the water head is pulled outward, the spring is pressed by the slide portion of the movable tube until a maximum pressing force of the slide portion exerts to the spring, then the water head is released so that the spring bounces to drive the movable tube to retract until the slide portion is engaged with the body, and the movable tube and the water head move back to the original position;

a depressurization element including a first face, a second face opposite to the first face, a peripheral face defined between and connected with the first face and the second face, multiple flowing apertures defined proximate to a center of the depressurization element and communicating with the first face and the second face, wherein the depressurization element is received in the accommodation portion of the body, and the depressurization element is configured to reduce a pressure of the water from the body to the movable tube; and a fitting pipe fitted in the upright extension of the water supply tube, wherein the fitting pipe includes a through hole defined adjacent to a top of the fitting pipe, a receiving orifice passing through a joining portion and communicating with the through hole, and a shoulder formed on a connection portion of the receiving orifice and the through hole, wherein the through hole and the receiving orifice are configured to accommodate the movable tube, and the slide portion of the movable tube is slidably received in the receiving orifice of the fitting pipe.

2. The telescopic structure as claimed in claim 1, wherein the depressurization element is received in the accommodation portion of the body and is fixed by an annular defining sheet.

3. The telescopic structure as claimed in claim 1, wherein the multiple flowing apertures are separately and annularly defined proximate to the center of the depressurization element.

4. The telescopic structure as claimed in claim 1, wherein a cross section of a respective flowing aperture is triangular.

5. The telescopic structure as claimed in claim 1, wherein the first face has a column extending from a center thereof.

6. The telescopic structure as claimed in claim 1, wherein the second face has a circular notch defined on a center thereof, the multiple flowing apertures are located in the circular notch, and the notch has a circular rib extending on a center thereof inside the multiple flowing apertures.

7. The telescopic structure as claimed in claim 1, wherein the peripheral face has multiple wings arranged separately.

8. The telescopic structure as claimed in claim 1, wherein the coupling portion is formed on an inner wall of an upper end of the body, the fitting pipe includes the joining portion formed on a bottom thereof, and the joining portion is fitted with the coupling portion of the body.

9. The telescopic structure as claimed in claim 1, wherein the body includes a water control portion mounted on an outer wall thereof, and the body includes a guide seat received therein, wherein the screwing portion is formed on a top of an upper end of the body, the coupling portion is formed on an inner wall of the upper end of the body, and the water outlet is defined on a top of the guide seat.

10. The telescopic structure as claimed in claim 1, wherein the screwing portion of the body has an external thread, and the screw element has an internal thread formed thereon, wherein the internal thread of the screw element are screwed with the external thread of the screwing portion of the body so that the water supply tube is connected with the body.

11. The telescopic structure as claimed in claim 1, wherein the fixing portion protrudes annularly and has two washers fitted on a top and a bottom thereof.

12. The telescopic structure as claimed in claim 1, wherein the slide portion has at least one seal ring fitted thereon.

* * * * *